United States Patent [19]

Seragnoli

[11] 4,144,695

[45] Mar. 20, 1979

[54] DEVICE FOR FOLDING THE HEAD PORTIONS OF INNER WRAPPERS IN A MACHINE FOR PACKETING CIGARETTES INTO HINGED-LID TYPE PACKETS

[75] Inventor: Enzo Seragnoli, Bologna, Italy

[73] Assignee: G. D. Societa per Azioni, Bologna, Italy

[21] Appl. No.: 823,928

[22] Filed: Aug. 12, 1977

[51] Int. Cl.[2] ..... B65B 11/28; B65B 49/08

[52] U.S. Cl. ..... 53/234; 53/378

[58] Field of Search ..... 53/234, 374, 375, 378; 92/12 R, 12 C

[56] References Cited

U.S. PATENT DOCUMENTS 3,802,325 4/1974 Bardenhagen ..... 93/12 C 3,948,115 4/1976 Seragnoli ..... 53/234 X

*Primary Examiner*—John Sipos

*Attorney, Agent, or Firm*—Kurt Kelman

[57] ABSTRACT

In the hinged-lid type cigarette packets, the upper flap protruding from the front wide side of the inner wrapper should, for convenience in the use, be folded over the upper flap protruding from the rear wide side of the same inner wrapper. In some of the conventional soft type packeting machines the folding disposition of the upper flaps is exactly opposite to the one above described, and the present invention provides for a device which allows the use, in a hinged-lid type packeting machine, of a rotating wrapping head normally used in the soft type packeting machine, since said device reverses the folding disposition of the upper flaps.

3 Claims, 5 Drawing Figures

DEVICE FOR FOLDING THE HEAD PORTIONS OF INNER WRAPPERS IN A MACHINE FOR PACKETING CIGARETTES INTO HINGED-LID TYPE PACKETS

BACKGROUND OF THE INVENTION

The present invention relates to an improved device for folding the head portions of inner wrappers in a machine for packeting cigarettes into hinged-lid type packets.

DESCRIPTION OF THE PRIOR ART

The wrapping elements making up a hinged-lid type cigarette packet are, as known to the man skilled in the art, the tin foil inner wrapper and the outer box.

The inner wrapper can be wound about a batch of cigarettes according to several wrapping styles: in the present specification reference will be made to the use of the wrapping style known as "soap style wrap".

In said wrapping style, the wrapper — obtained from a rectangular length of tin foil — is wound as a tube, and in the direction of its greater dimension, for wrapping the four longitudinal sides of the cigarette batch, thus to have its two extremities parallel to the axes of the cigarettes.

The cigarette ends are then covered by folding down the flaps of the length protruding from the two extremities, by folding — in particular — firstly the flaps protruding from the opposite extremities of the narrow sides of the batch, and then the flaps protruding from the opposite extremities of the wide sides of the batch.

In order to remove the cigarettes from a hinged-lid packet, the upper extremity of the batch is partially opened by firstly lifting the lid of the packet, and then by tearing off a portion of the tin foil inner wrapper. In order to facilitate the latter operation, this portion is bordered by a series of cuts which make the detaching of said portion easier.

Such portion is grasped on the upper flap protruding from the front wide side (viewing FIG. 1) of the inner wrapper.

It is obvious, for this reason, that — in order to make this operation faster — the flap to be grasped has to be folded over the flap protruding from the opposite rear wide side of the inner wrapper. In other words, it is advisable that — during the manufacturing of the inner wrapper — the flap to be grasped, and forming part of the portion to be removed, be the last to be folded.

The hinged-lid type packeting machine, to which reference is made in the present specification, is diagrammatically shown in FIG. 2.

Which only illustrates the rotating heads for carrying out the various wrapping operations of the cigarette batches. The means for forming the cigarette batches and for transferring said batches to the wrapping heads have not been shown since they are well known.

In particular, starting from rigth to left, the first of said rotating heads is supported by a horizontal shaft, and is the station wherein the cigarette batches are wound by a tin foil inner wrapper. A second rotating head, supported by a vertical shaft, follows said first rotating head, and is the station wherein the already wrapper batches are provided, if required, with a revenue stamp, or with an advertising picture. A third rotating head also supported by a vertical shaft follows, for the application of the so called 'collar' and for the feeding of a thin cardboard blank; and — at last — a further rotating head supported by a horizontal shaft for obtaining, from the blanks, the hinged-lid packets.

The wrapping style, above defined as "soap style wrap", is also used for obtaining the inner wrappers of soft type cigarette packets (or American type packets) produced by a high speed cigarette packeting machine manufactured by, G. D. Societa per Azioni, and described — for example — in its U.S. Pat. Nos. 3,628,309, 3,948,115 and application No. 423,178 filed Dec. 10, 1973 now abandoned.

The hinged-lid type packeting machine, diagrammatically shown in FIG. 2, has substantially the same structure as the soft type packeting machine described in the above cited patents. This is particularly true for the means for forming and transferring the cigarette batches, as well as for the first rotating head for wrapping said batches with a tin foil wrapper.

In the known, soft type packeting machine, the rotating head is intermittently moved clockwise and is provided with eight peripherically and radially disposed compartments.

At each rotational step, one of said compartments comes to dwell in a station, called inlet station, horizontally aligned relative to transferring means for inserting into each of said compartments a cigarette batch, together with a length of wrapping material (tin foil).

As known, the cigarette batch is longitudinally positioned relative to the compartment, and positioned edgewise relative to the axis of the rotating head.

During the rotation of the head, stationary and movable folding means operate to wind the length of wrapping material so as to wrap the four longitudinal sides of the cigarette batch, and to fold the flaps protruding from the narrow sides onto the two ends of the batch.

In the same dwelling position, the flaps protruding from the wide sides are then folded down onto the two ends, i.e. firstly the uptream flap, relative to the rotating direction of the head, and then the downstream flap.

The choice of such a folding order, rather than the opposite one, allows to carry out the final wrapping operations in the simplest way, and in the shortest time.

It should be noted that, in these conditions, the final folding of the downstream flap can be completed by stationary folding means during the transferring of the compartment from one to the next dwelling position.

From the above it appears that, during the ejection of a packet from the rotating head, along a horizontal plane diametrally positioned relative to the inlet station, the tin foil inner wrapper presents the upper flap partially superimposed to the lower flap.

For this reason, and as thereinafter demonstrated, the possibility of a simple transfer to the hinged-lid type packeting machine diagrammatically shown in FIG. 2 to the first rotating head used in the soft type packeting machine is not possible. In the hinged-lid type packeting machine, the cigarette batch — wound about the tin foil inner wrapper — maintains, relative to its horizontal supporting plane, and between two subsequent vertical axis rotating heads, the position which it had when ejected from the first rotating head.

The upper face of the inner wrapper will come to adhere, in correspondence of the second vertical shaft rotating head, to that surface of the blank which will form — at the completion of the wrapping operations — the back surface of the hinged-lid type packet (see FIG. 1).

In conclusion, the use of the described rotating head in a hinged-lid type packeting machine of the type diagrammatically shown in FIG. 2 would result in a hinged-lid type packet different from the one shown in FIG. 1, i.e. in a packet having the flap from the rear wide side of the inner wrapper partially overlapping the flap from the front wide side of the same wrapper, which is contrary to what is desired.

SUMMARY OF THE INVENTION

An object of the present invention is, therefore, to provide a device adapted to allow the use in a hinged-lid type packeting machine, for the wrapping of cigarette batches into a tin paper inner foil, of a rotating head of the type described with reference to the soft type packeting machine.

A further object is to provide a device for obtaining, in conformity with the above stated object, tin foil inner wrappers having in correspondence of the ejecting station of a rotating head of the type above described, the flap associated with the upper face superimposed with the flap associated with the lower face, the upper and lower faces being referred to a horizontal plane.

These and other objects are all attained with the improved device, according to the invention, for folding the head portions of inner wrappers in a machine for packeting cigarettes into hinged-lid type packets, said machine substantially comprising: a plurality of stations for folding the wrapping material, each station having a radially compartmented wheel for housing individual cigarette batches to the wrapped; stationary and movable folding means for folding said wrapping material about said cigarette batches; transfer means for subsequently transferring said cigarettes batches and related wrapping material from one wheel to the next one; and a driving kinematic mechanism substantially comprising a stepwise device for step-by-step rotation of each wheel, and including a continuously rotating shaft, a driving means for said movable folding means, and a driving means for said transfer means, the continuously rotating shaft of at least one of said stepwise devices being associated with a pair of said movable folding means, each pair being formed by two folding blades positioned on the opposite sides of said wheel in a station wherein successive compartments are brought with dwell, said blades being associated to an oscillatable shaft oscillated by a kinematic mechanism linked to a driving cam keyed to said continuously rotating shaft, which improved apparatus is characterised in that the driving cam for driving the folding blades is positioned downstream relative to the rotating direction of the related wheel is associated with the corrisponding driving kinematic mechanism through a member pivoted for oscillation about a stationary pivot point and provided, at points spaced from the pivot point, with a cam-follower cooperating with the same driving cam and of a too-thing engaging a corresponding toothing of said oscillatable shaft the operating profile of said cam being shaped to drive the associated folding blades to carry out, in sequence, a first oscillating movement in a direction opposite to the rotating direction of said wheel, a dwell, a second oscillating movement in a direction opposite to the first oscillating movement, a third oscillating movement in the same direction as said first movement, and a fourth oscillating movement in the direction of said second movement to bring said folding blades back to their starting position.

BRIEF DESCRIPTION OF THE DRAWINGS

Further features and advantages will be more apparent from the following description of a preferred embodiment of the improved device according to the invention, as shown by way of example in the accompanying drawings, in which.

DESCRIPTION OF THE PREFERRED EMBODIMENT

Figure 2:
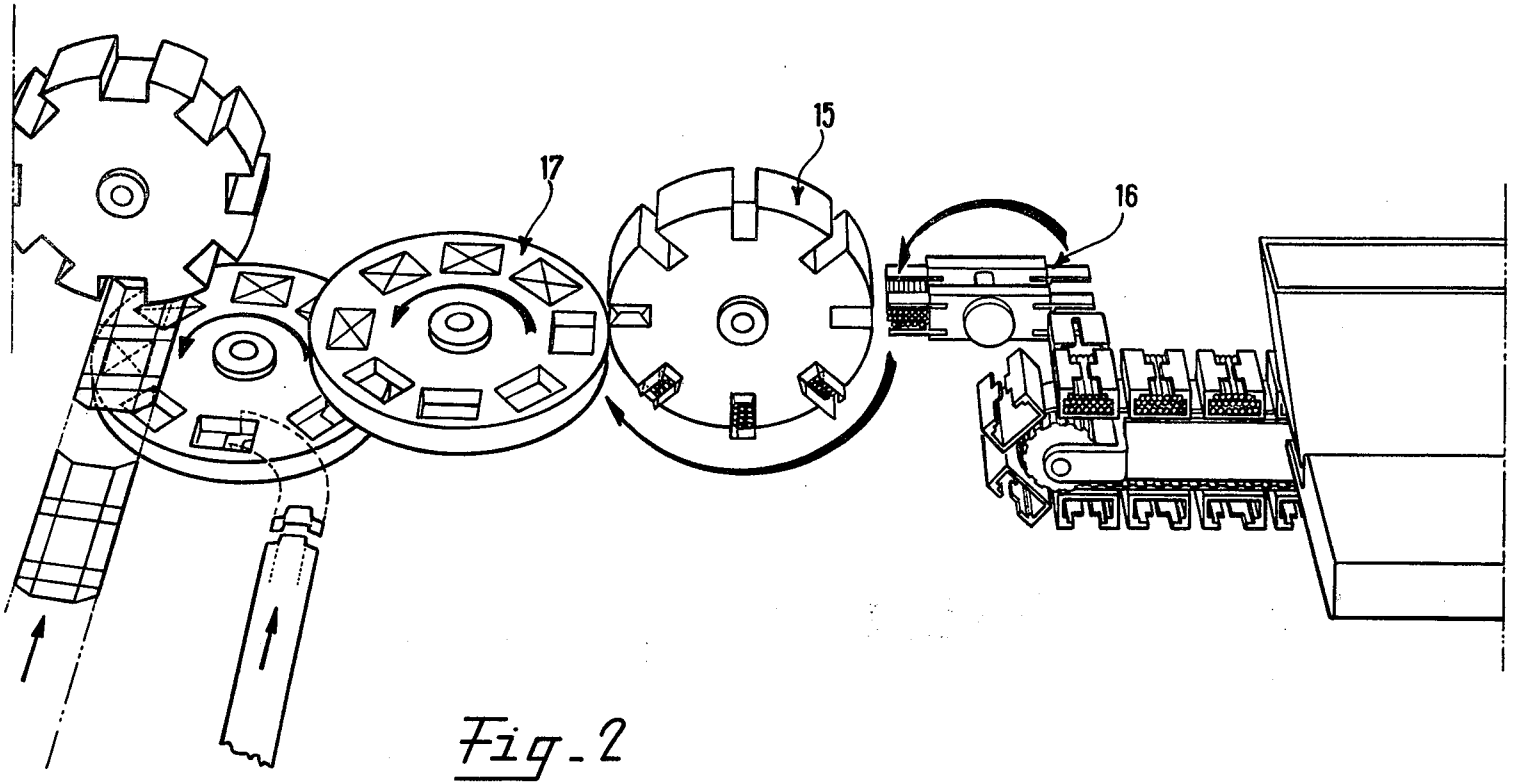
FIG. 2 is a diagrammatic perspective view of a hinged-lid type packeting machine.
Figure 3:
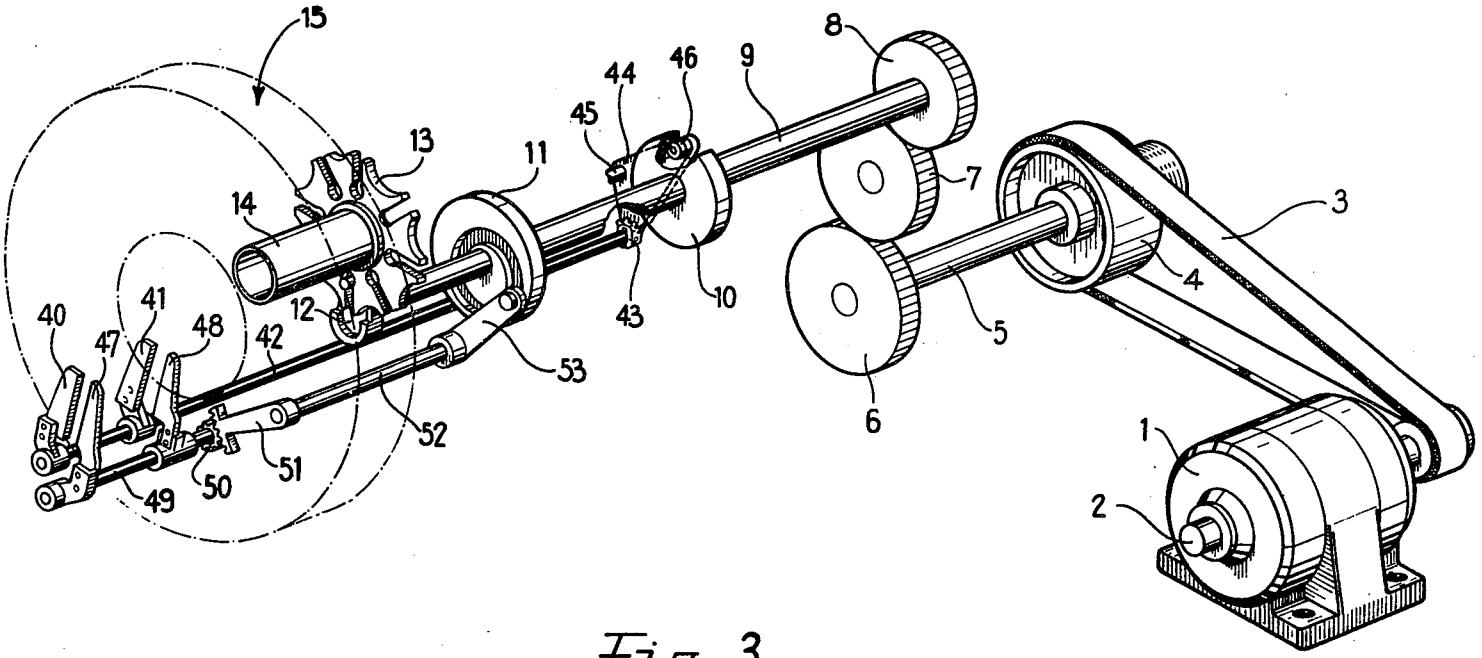
FIG. 3 is a perspective view of the driving means for driving the machine of FIG. 2, and for controlling the improved device according to the invention.

With particular reference to FIG. 3, with 1 is indicated an electric motor for driving the machine diagrammatically shown in FIG. 2. Belt 3 and pulley 4 transmit the drive from motor shaft 2 to a horizontal shaft 5 having a gear wheel 6 keyed to one end thereof.

The gear wheel 6, through an idle gear 7, drives a gear 8 keyed to the right end of a shaft 9, parallel to shaft 5. On shaft 9 are further keyed, starting from right to left, two grooved driving cams 10 and 11, the task of which will be described thereinafter. On the left end of shaft 9 is keyed a conventional device 12 formed by an arcuate sector and by an idle roller for intermittently operating an eight-spaces Maltese cross 13.

Figure 4:
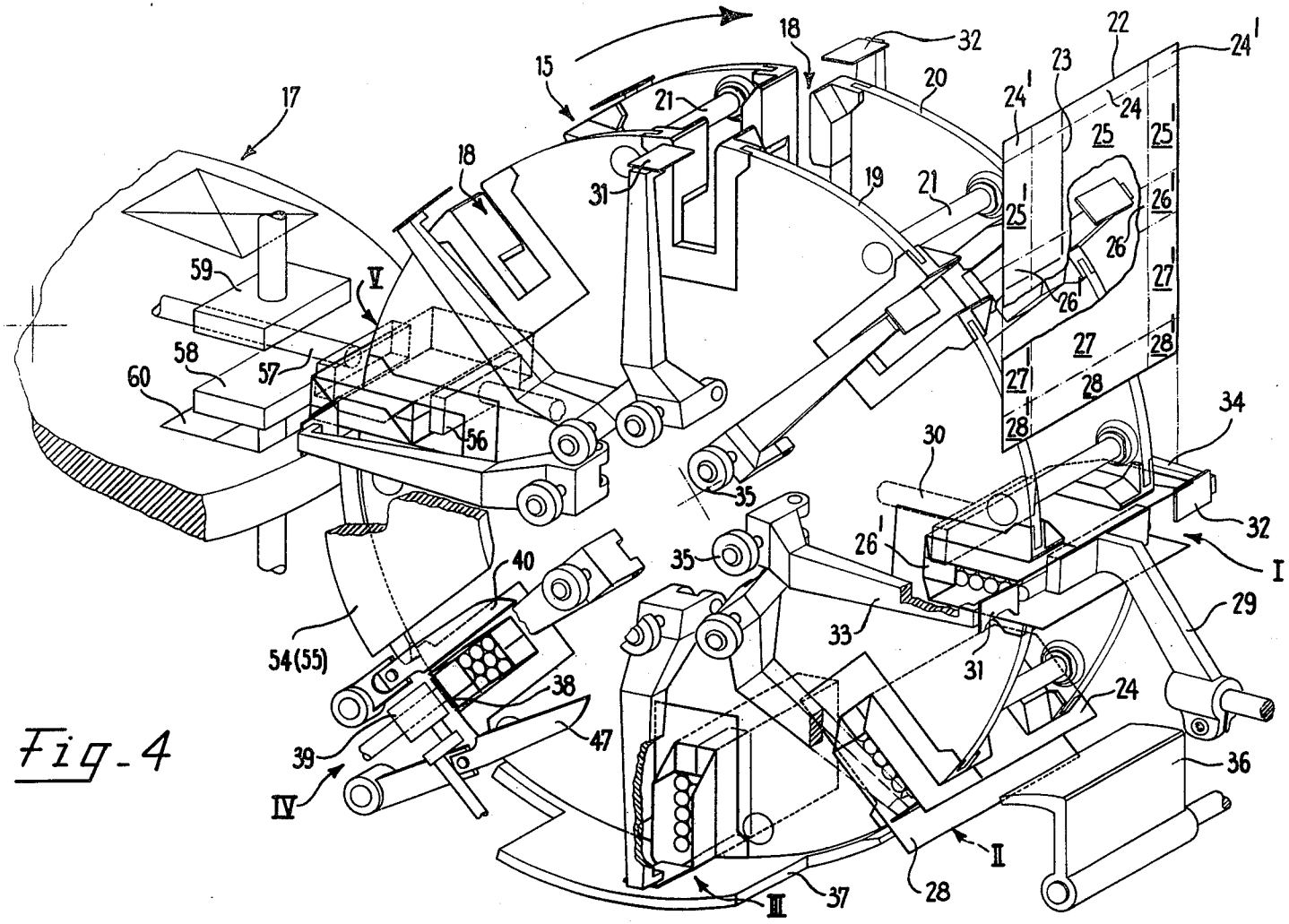
FIG. 4 is a perspective view of the wrapping wheel of the hinged-lid type packeting machine, and of the improved device according to the present invention.

The Maltese cross 13 is keyed to tubular sleeve 14 to which is fastened, externally of the machine's bed (not shown), a cylindrically shaped rotating head or wheel 15, shown in FIG. 4, for wrapping respective cigarette batches into a tin foil wrapper.

The rotating head 15, to which cigarette batches are delivered by wheel 16 having two compartments (see FIG. 2), and feeding in its turn wheel 17 rotating about a vertical axis, is intermittently and clockwise rotated, with a 45° rotation for each step, and is provided with eight radially disposed compartments 18, peripherically positioned at 45° one from the other.

The rotating head 15 is substantially formed by two coaxially disposed disks 19 and 20, spaced apart by a distance corresponding to the length of a cigarette, and fastened one to the other by rods 21 parallel to the axis of rotation of the head.

The compartments 18, obtained by radially cutting the body of the head 15, are adapt to contain parallelepipedon forms having dimensions corresponding to those of the cigarette batches longitudinally and edgewise positioned relative to axis of rotation. Said compartments 18 are each provided with an inlet opening positioned on the cylindrical periphery of head 15, and are open at the two longitudinal ends.

On the right, viewing FIG. 4, of the rotating head 15, along a vertical plane are conventionally fed rectangular lengths 22 of tin foil wrapping material each provided, on a corner, with a weakening line 23 obtained with the device described in the U.S. Ser. No. 560,700, filed Mar. 21, 1975 now abandoned.

In order to make easier the understanding of the following description, the lengths 22 are each subdivided, by broken folding lines into areas or panels delimiting the various faces of the inner wrapper. Such areas are indicated, from top to bottom, with reference numerals 24, 25, 26, 27, and 28, while the same reference numerals with the addition of an index (') indicate the two extremities, or flaps, of each of said areas forming, as will be described thereinafter, the two head portions of the inner wrapper. The compartments 18 are each brought to dwell in sequence in line with an inlet station I.

As described in the above cited U.S. Pat. Nos. 3,628,309, 3,948,115 and application Ser. No. 423,178 the transfer of a cigarette batch with a movement transversally directed relative to the axes of the cigarettes, together with a length of wrapping material, into a compartment 18 dwelling in line with the station I is carried out by a pusher 29 cooperating with a counter-pusher 30, both carried by horizontal shafts, and reciprocatingly and radially moved relative to the rotating head 15.

In its forward stroke, the counter pusher 30 approaches a length 22 of tin foil wrapping material standing in proximity of station I from the back, as seen in FIG. 4, thus carrying the panel 26 to contact the left side of the cigarette batch.

During the introduction of the cigarette batch into a compartment 18, the two panels 25 and 27 are progressively folded onto the upper and lower layers of cigarettes forming the batch. As soon as the introduction of the batch into the compartment is completed, while the counter-pusher 30 moves away from panel 26, the pusher 29 begins its backward stroke.

The cigarette are held within the compartment 18 by rectangular plates 31 and 32 synchroneously moved to engage the longitudinal extremities of the cigarette batch.

Plates 31 and 32 are integral with the extremities of arms 33, 34 oscillating in the same radial plane, and about fulcra carried by the disks 19 and 20.

Each compartment 18 is provided with arms 33 and 34, constituting two symmetrical systems relative to the rotating head 15. Idle rollers 35 are provided near the fulcra of arms 33 and 34, and cam means (not shown, but described in the U.S. Pat. No. 3,948,115) impart to arms 33 and 34 through said rollers 35 an oscillating movement to move and remove the plates 31 and 32 towards and away from the relative compartment 18. Plates 31 and 32, and with compartment 18 still dwelling in station I, fold the two flaps 26' over and against the ends of the cigarette batch.

The head 15 is then rotated clockwise, and the considered compartment 18 is transferred to a station II positioned 45° from the inlet station I.

While dwelling in station II, the flap 24, protruding from the upper part of compartment 18, is folded down by a hoe-shaped folder 36, tangentially to the cylindrical periphery of rotating head 15, which folds said flap 24 over the outer side of the cigarette batch.

The head 15 is further rotated to station III, positioned 90° from inlet station I. During this rotation and before panel 24 moves away from folder 36, the panel 28 is turned over by a stationary guide 37 concentric with the rotating head 15, and circumscribing the periphery of the head starting from station II up to a station V for ejecting the wrapped batches.

During these phases, the two plates 31 and 32 conventionally act as counteracting elements against the action of the folder 36, and of the stationary guide 37, thus avoiding damage to the cigarettes, and further allowing to obtain well defined corners between panels 25 and 24, and between panels 27 and 28.

During the transfer of a compartment 18 from station II up to station III, the cited cam means causes the opening of arms 33 and 34, and the removal of plates 31 and 32 from between the overlapped panels 24 and 28.

The cigarette batch, partially wrapped by the length 22, is prevented from moving relative to compartment 18 by the stationary guide 37.

The considered compartment 18 is then rotated to station IV where stationary guide 37 is interrupted to allow for the insertion of a block member 38, to which an oscillating motion is imparted by means described in the above cited U.S. Pat. No. 3,948,115.

The block member 38 is firstly oscillated and brought to act on overlapped panels 24 and 28, thus maintaining said panels in their relative overlapped position. The two flaps 24' and 28', forming the extremities of panels 24 and 28, are then folded over and onto the two ends of the cigarette batch.

This is carried out by means of oscillating folders 39 (only one is shown in FIG. 4), described in detail — together with their own driving means — in the above cited U.S. Pat. No. 3,948,115.

At the end of such operation, and during the same dwell, the flaps 27' protruding from the two disks of the rotating head, and downstream relative to the head rotating direction are folded over the two ends of the batch.

The folding of the flaps 27' is carried out by a first pair of oscillating folding blades 40 and 41, engaging flaps 27' edgewise during their forward stroke, thus folding the flaps onto the opposite ends of the cigarette batch.

Blades 40 and 41 are secured to a common rocking shaft 42, parallel to shaft 9, and provided at one end thereof with a toothed sector 43 meshing with a gear provided on a vertex of pivotal triangular plate 44, another vertex of which plate 44 is pivoted on a stationary pivot point or pin 45 affixed to the bed of the machine. A third vertex of plate 44 is provided with an idle cam follower 46 engaging the groove of cam 10.

The groove of cam 10 is so shaped that, at the end of their forward oscillating stroke, the two folding blades 40 and 41 stay at rest until completion of the folding of flaps 25', protruding from the side disks 19 and 20 of the rotating head 15, upstream relative to the rotating direction of the head.

The folding of flaps 25' is carried out by a second pair of oscillating blades 47 and 48 which, during their forward oscillating stroke, fold down the two flaps 25' onto the blades 40 and 41, the latter acting — in this stage — as rigid countersupports having substantially the same function as plates 31 and 32.

Blades 47 and 48 are keyed to common shaft 49, on which a gear 50 is also keyed. Gear 50 engages a toothed sector carried by one extremity of a lever 51 secured to a shaft 52 affixed to a second lever 53 provided with an idle cam follower engaging the groove of cam 11.

Blades 40 and 41, therefore, during their backward oscillating stroke disengage themselves from beneath the flaps 25', and said flaps 25' come consequently to rest on underlying flaps 27'.

During the backward oscillating stroke of blades 47 and 48, and before their disengagement from the head portions of the wrapper, the blades 40 and 41 are again oscillated, thus overlapping flaps 25'.

The continuous presence of retaining means tightly contacting the two head portions of the wrapper has, during this stage of the wrapping operation of the cigarette batch, the essential task of avoiding that the flaps 25' folded, for the purpose above mentioned, in a direction opposite to the rotating direction of head 15, could interfere — at the beginning of the rotation of said head — with blades 40 and 41 or, as will be seen thereinafter, with downstream positioned guiding means.

As soon as block member 38 has been disengaged from panels 24 and 28, i.e. after completion of its task of containing and holding the cigarette batch and of the related wrapper within compartment 18, the head 15 is further rotated to transfer the considered compartment to the ejection station V.

Contact of flaps 27' and 25' with the opposite ends of the batch is assured, during the starting phase of this last transfer by the blades 40 and 41 still adhering to the extremities of the compartment and also during their backward oscillating stroke which is performed during the rotation of head 15 and then, without any discontinuity by two lateral crown shaped guides 54 and 55 (only one is shown in FIG. 4), adhering to the opposite sides of the rotating head 15.

In station V, diametrically opposite to the inlet station I, the ejection of the wrapped batch is carried out by a pusher 56 reciprocatingly moved and radially positioned relative to head 15.

The pusher 56 engages, in a conventional manner, the wrapped batch along its inner side, while a counter-pusher 57 engages the outer side of the wrapped batch. The batch is thus transferred onto a vertically and reciprocatingly movable elevator 58, dwelling in its uppermost position at the same level as station V.

The elevator 58, cooperating with a counter-elevator 59 which approaches the upper face of the wrapper, at the end of its downwardly directed stroke transfers the wrapped batch into one of a plurality of compartments 60 of head 17.

Figure 1:
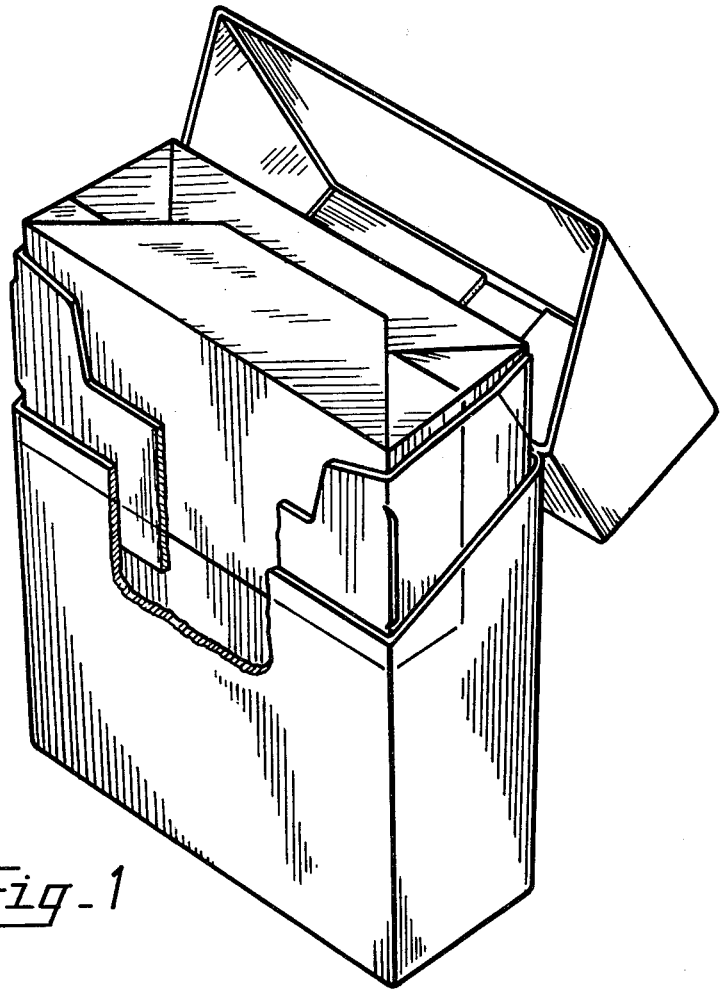
FIG. 1 is a perspective view of a hinged-lid type cigarette packet, some parts having been removed for a clear showing of other parts.
Figure 5:
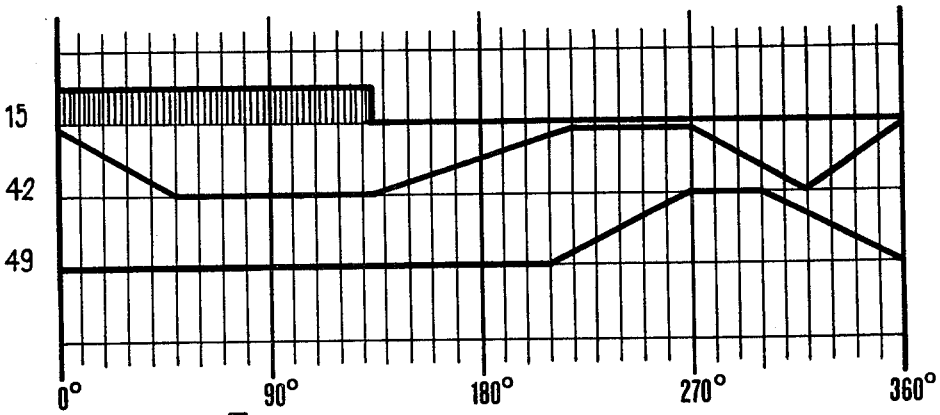
FIG. 5 shows in graph from the sequence of motions relating to a machine cycle of some of the most important parts of the hinged-lid type packeting machine, and of the improved device according to the invention.

FIG. 5 diagrammatically shows, as a function of rotation degrees of a common driving shaft (for example, shaft 9), the dwells and movements of rotating head 15, of shaft 42 with which the first pair of folding blades 40 and 41 is associated, and of shaft 49 with which the second pair of folding blades 47 and 48 is associated.

In the graph relating to rotating head 15 the portion coinciding with the horizontal axis represents the dwelling time, and the dashed area represents the movement times; in the graph relating to shafts 42 and 49 the horizontal portions indicate the dwelling times, the upwardly directed portions represent the forward movement times, and the downwardly directed portions represent the backward movement times.

I claim:

1. In a machine for packeting batches of cigarettes into hinged-lid type packets, which comprises a plurality of wheels and at least one of said wheels defining radial compartments for housing respective ones of the batches of cigarettes to be wrapped in inner wrappers having an end portion, said one wheel being rotatable to position the compartments in a plurality of successive stations for folding the inner wrappers about the respective batches of cigarettes; stationary and movable folding means for folding the inner wrappers about the batches of cigarettes, the movable folding means including two pairs of folding blades for folding end portion of the wrappers and positioned at opposite sides of the wheel in one of the stations wherein successive ones of the compartments are positioned to dwell; transfer means for subsequently transferring the wrapped batches of cigarettes from the wheel to an adjacent wheel; and a kinematic driving mechanism with a stepwise device for step-by-step rotation of each one of the wheels including a continuously rotating shaft, a driving means for the movable folding means and a driving means for the transfer means, the continuously rotating shaft of said stepwise device being associated with the two pairs of folding blades; a driving cam keyed to said continuously rotating shaft; a kinematic mechanism linked to the driving cam and a rocking shaft oscillated by the kinematic mechanism, the rocking shaft being associated with the folding blades: the improvement of (a) a rocking member pivotal about a stationary pivot and connecting the driving cam with the kinematic mechanism, the rocking member carrying at respective points spaced from the stationary pivot
  (1) a cam follower cooperating with the driving cam and driven thereby and
  (2) a gearing which is part of the kinematic mechanism; and (b) another gearing on the rocking shaft forming another part of the kinematic mechanism and meshing with the gearing on the rocking member,
  (1) the driving cam being shaped to drive the folding blades so that they sequentially carry out a first oscillating movement in a direction opposite to the direction of rotation of the wheel, a dwell, a second oscillating movement in a direction opposite to the direction of the first oscillating movement, a third oscillating movement in the same direction as the direction of the first oscillating movement, and a fourth oscillating movement in a direction of the second movement to return the folding blades to their starting position, the first movement, the dwell, the second movement and the third movement occurring during a single dwell of the wheel and the fourth movement occurring during the next movement of the wheel.

2. In the machine of claim 1, the rocking member being a triangular plate, the stationary pivot, the cam follower and the gearing being positioned at the respective vertices of the triangular plate.

3. In the machine of claim 1, wherein the gearing on the rocking member is a toothed arcuate sector.

* * * * *